US005683284A

United States Patent [19]

Christen

[11] Patent Number: 5,683,284

[45] Date of Patent: Nov. 4, 1997

[54] GYROSCOPIC TOP TOY

[75] Inventor: Richard Paul Christen, Sandy, Oreg.

[73] Assignee: Hart Enterprises, Inc., Vancouver, Wash.

[21] Appl. No.: 600,484

[22] Filed: Feb. 12, 1996

[51] Int. Cl.[6] ..... A63H 1/00; A63H 17/00

[52] U.S. Cl. ..... 446/233; 446/484; 446/437

[58] Field of Search ..... 446/233, 234, 446/235, 236, 242, 256, 264, 265, 484, 437, 488; 482/110

[56] References Cited

U.S. PATENT DOCUMENTS

| | | | |
|---|---|---|---|
| 1,073,880 | 9/1913 | Voltz | 446/233 |
| 3,019,555 | 2/1962 | Poitcha . | |
| 3,533,187 | 10/1970 | Campbell . | |
| 3,628,285 | 12/1971 | Murakami . | |
| 4,277,912 | 7/1981 | Hsien . | |
| 4,333,262 | 6/1982 | Kimura | 446/484 |
| 4,453,342 | 6/1984 | Sahar . | |
| 4,631,041 | 12/1986 | Chang et al. | 446/233 |
| 4,713,039 | 12/1987 | Wong . | |
| 4,923,196 | 5/1990 | Rohring | 446/233 X |
| 5,172,806 | 12/1992 | Mickelberg | 446/488 X |

FOREIGN PATENT DOCUMENTS

| | | | |
|---|---|---|---|
| 348561 | 8/1937 | Italy | 446/233 |
| 1235153 | 6/1971 | United Kingdom | 446/233 |

*Primary Examiner*—D. Neal Muir

*Attorney, Agent, or Firm*—Ronald M. Goldman

[57] ABSTRACT

A self contained battery operated electric toy spinning top contains a DC electric motor, flywheel, batteries and electric switch in stacked relationship that allows for efficient assembly of a gyroscopic toy. A spinning cardboard carton is produced by installing the energized top within the carton.

11 Claims, 2 Drawing Sheets

GYROSCOPIC TOP TOY

FIELD OF THE INVENTION

This invention relates to gyroscopic toys and, more particularly, to a self contained battery operated spinning top toy.

BACKGROUND

The gyroscope has been employed, not only to demonstrate physical principals of inertia and moment, but as a source of amusement and as a driving mechanism within novelty devices, toys, intended for play by children. Illustrations of such toy applications are found in the prior patent literature. As example, U.S. Pat. No. 4,713,039 illustrates a battery operated motor driven gyroscopic toy top containing a motor rotated flywheel enclosed in a domed housing; U.S. Pat. No. 3,628,285 illustrates another construction for a battery operated gyroscopic top; and U.S. Pat. No. 4,453,342 still another. The present invention is also directed to gyroscopic toys, in particular to spinning tops and the like.

An object of the present invention, therefor, is to provide a new children's amusement device;

A further object of the invention is to provide a gyroscopic type toy having the appearance of a small carton or box; and A still further object of the invention is to provide a novel construction for a battery operated self contained spinning top that allows for efficient manufacture and assembly.

SUMMARY OF THE INVENTION

The present invention provides a novel construction of a gyroscopic toy, one that may be efficiently manufactured and assembled at high production volumes. The invention also provides new forms of presentation. In accordance with one aspect, the new toy is characterized by a housing whose shape resembles the shape of the familiar string powered spinning top, but is electrically propelled in rotation by a battery energized DC electric motor and flywheel arrangement contained within the housing. The top spins non-stop until the electric batteries are depleted or the control switch is turned to the off position and the inertia in the flywheel is expended through friction.

The unique construction is characterized by installing the electric motor, gyroscopic flywheel, batteries and electric switch in stacked relationship with plastic disks located intermediate the motor and flywheel and between the flywheel and the remaining components. Preferably the flywheel is unbalanced, slightly, to produce pulse energy, and the structure's center of gravity lies above the flywheel, whereby such pulse energy is focused at the top's tip. As a result, the tip proceeds to "walk" on the support surface, such as a table top, when the top is manually nudged from a true vertical orientation.

Additionally, in accordance with another aspect to the invention, a gyroscopic amusement device takes the form of a rectangular shaped cardboard box or container, such as that in which a top of the foregoing construction is marketed. With the top confined within the box with its bulbous tip end located in a corner and with the top spinning, by placing the corner of the box on a table top, the box rotates on its corner, and thereby serves as a source of additional amusement and play.

The foregoing and additional objects and advantages of the invention together with the structure characteristic thereof, which was only briefly summarized in the foregoing passages, becomes more apparent to those skilled in the art upon reading the detailed description of a preferred embodiment, which follows in this specification, taken together with the illustration thereof presented in the accompanying drawings.

DETAILED DESCRIPTION OF THE PREFERRED EMBODIMENTS

Figure 1:
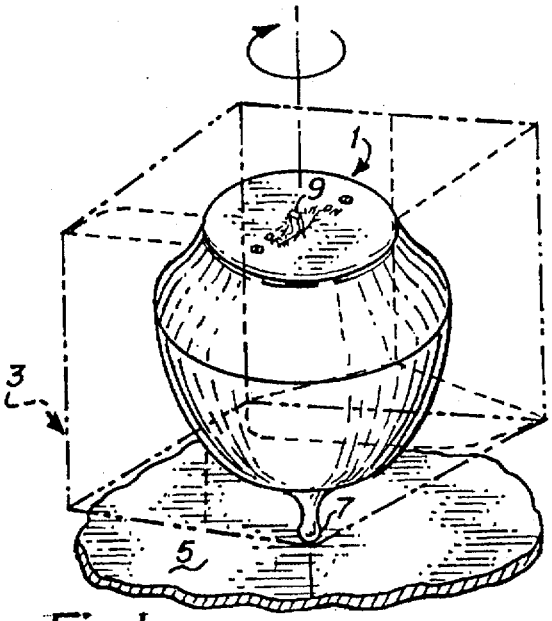
FIG. 1 illustrates the spinning box and spinning top invention.

Reference is made to FIG. 1 which illustrates an embodiment of the spinning box aspect to the invention. In this figure, the box is shown balanced on one corner, presenting a snap shot picture in time of the dynamic of gyroscopic action, and not as a gravity defying illusion. In this the novel electric top 1, described hereafter in detail, is disposed within a box or carton 3, shown with the box flaps and cover panel closed, and the carton in turn is disposed on its corner upon a table top 5, preferably containing a smooth surface, such as a conventional laminate surface.

The carton is formed of cardboard sheet material, uncorrogated, of conventional thickness, suitably 0.020 inches thick, is light in weight, suitably a fraction of an ounce, and is sized to permit the top's confinement inside with the top's tip end located within one of the eight corners of the box and with minimal clearance between the top's surfaces and the box walls. Essentially the carton is the container in which the electric top is marketed and sold.

Serving as a package for the electric top, the outer surfaces of the carton, as is customary, contains printed material, not illustrated, which gives the consumer information on the contents. That printed material gives the outer surfaces a more slick or smooth texture in comparison to the box's inner surfaces. That printed surface may be formed by ink applied directly to the cardboard or ink applied to a paper layer integral with the outer cardboard surface. Such printed material of one type or another appears on all outer surfaces of the box. It is appreciated that the carton is fabricated and printed by conventional technique using automatic carton manufacturing equipment, the details of which are not material to an understanding of the invention.

Electric top 3 is generally of the familiar top shape, containing a wide curved body, a figure of revolution about a central axis, bulbous at the upper side and tapering down to a narrow bottom end or tip 7, usually rounded, and is formed of conventional plastic material, such as polystyrene. Tip 7 is of a smooth bulbous or spherical shape. The top also contains an upper surface 2 through which a switch operating arm 9 extends. When the user moves operating arm 9 to turn the electricity "on", the internal spinning mechanism within the top's body or housing, later herein described in detail, creates a rotational or spinning force on the top.

Although illustrated as flat in this figure, in alternative embodiments, other geometries, such as a rounded geometry, can be used for the upper surface and may be preferred. And with the latter alternative the rounded upper surface is formed with a recess or depression and the switch operating arm 9 is positioned to extend through a passage formed in the bottom of that depression, but lies entirely within the recess. That protects the operating arm from physical damage during play.

When placed in the box with its tip end in a corner and the operating arm 9 set to the "on" position, the top rotates at high speed. Setting that corner of the box down on the table top, it is found that the box, at least momentarily, appears to defy gravity by standing on its corner, and the box rotates on that corner.

Since the wall's of the box are essentially holding the outer surface of the top, the rotating motion of the confined top couples to the box. The inherent frictional engagement between the plastic material of the top and the cardboard surface of the carton's walls are found sufficient to rotate the carton. With the coefficient of resistance between the carton's outer surface, specifically the box's corner, and the smooth table top surface being low, the rotational force on the carton is sufficient to rotate the carton on that surface. It is appreciated that the carton may be spun with the upper flaps open, as illustrated, or those flaps may be closed. What the child perceives is a spinning box, which serves as a source of amusement. Not only does the child have a spinning top toy, but a spinning box toy, and at no additional cost.

Figure 2:
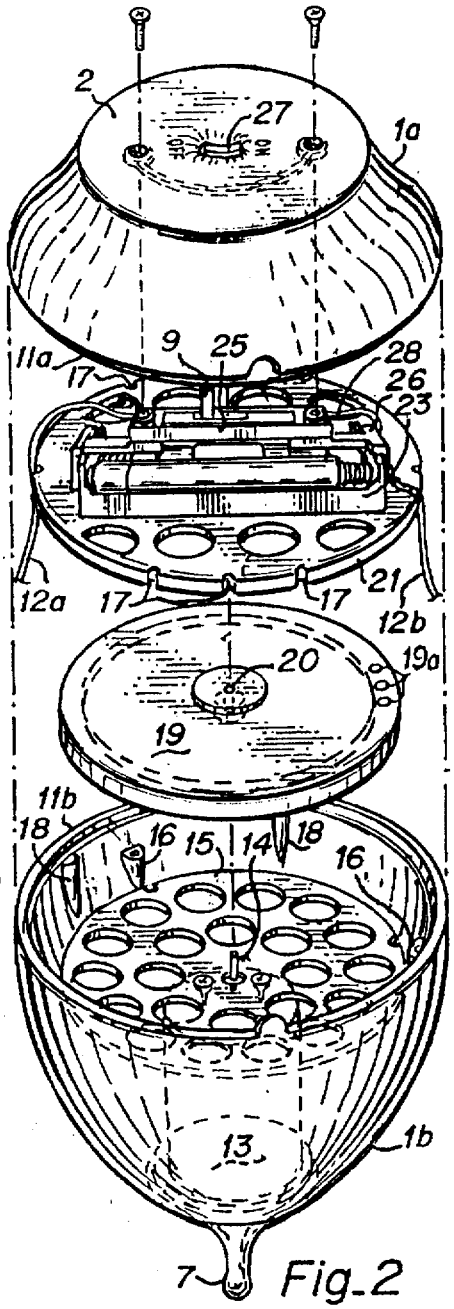
FIG. 2 is an exploded view of the top of FIG. 1.
Figure 3:
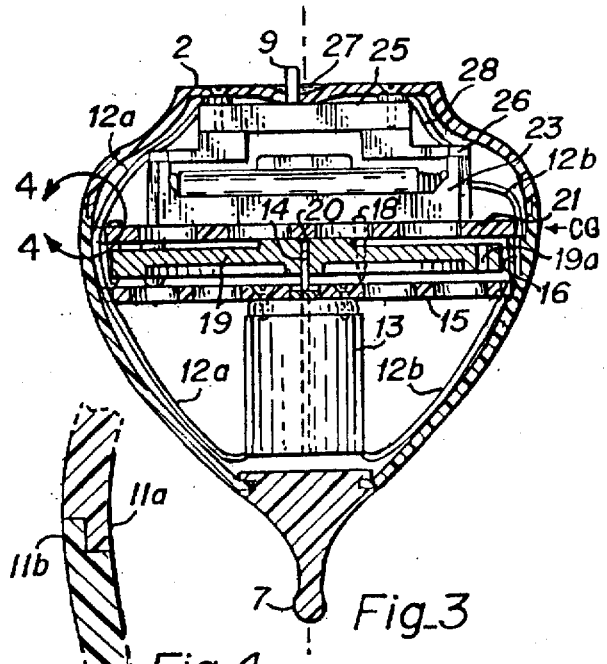
FIG. 3 illustrates the top of FIG. 1 in section view.
Figure 4:
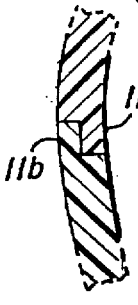
FIG. 4 is an enlarged partial section view of section 4—4 in FIG. 3.

The novel construction of top 1 is better illustrated in the exploded view of FIG. 2 and the section view of FIG. 3, to which reference is made. The top's housing is formed in two pieces, an upper housing member 1*a* and a lower housing member 1*b*, each of which is of thin walled plastic. Those housing members snap together by an interlocking tongue groove joint 11*a* and 11*b* formed along the confronting circular edges of each housing portion, better illustrated in the partial section view of FIG. 4, to form a unitary assembly having a smoothly curving outer surface, revealing but a thin circumferential line about the outer surface of the top and a hollow interior. Lower housing member 1*b* is formed with an open bottom end. Tip 7 is formed as a separate solid member, suitably of polystyrene plastic, and is fitted and permanently attached to an opening in the bottom end of the lower housing member, closing the bottom end.

A DC electric motor 13, a perforated plastic disk 15, a heavy metal flywheel 19, a second perforated plastic disk 21, which carries a battery holder 23 and an electric switch 25 in an assembly on the upper surface of disk 21, are installed, essentially in the order stated, within the hollow formed by the housing members.

Electric motor 13 is secured to the underside of plastic disk 15 by two screws accessible from the upper side surface of that disk, with its shaft 14 extending a short distance through a central passage in the disk, and is installed with that disk within the hollow. The motor is oriented vertically and is aligned coaxial with the top's central axis. As installed, the motor's rear end is elevated slightly above the inside surface of tip 7, as illustrated in FIG. 1, and its front end and shaft 14 are coaxial with the top's central axis.

Perforated disk 15 is lowered into place within the hollow of the lower housing member, together with the supported motor, and fits into place in proper orientation. At that elevational position above tip 7, the outer diameter of disk 15 is equal to the inner diameter of the wall of the lower housing member and portions of the disk's periphery are screwed and cemented to the wall to hold the disk in place. Alternatively the disk may suitably be guided into place by conventional key members, not illustrated, as may be molded into the inner housing walls.

Electrical leads 12*a* and 12*b* from motor 13 are conveniently threaded through a peripheral slot in each of disks 15 and 21 through to the respective battery terminal at compartment 23 and at electrical switch 25, later discussed, and are located close to the housing wall.

Metal Flywheel 19, suitably formed of steel or other member that is relatively heavy, suitably sixty five grams, relative to the second housing portion, defines a relatively large inertial mass suitable for a gyroscope type operation. The flywheel contains a central passage 20 through the flywheel's axis of symmetry in which to receive an end of the motor shaft 14 in a loose friction fit.

The flywheel is easily dropped into place in the lower housing member with its central passage receiving an end of shaft 14, whereby the shaft, during operation, may drive the flywheel in rotation. The diameter of the flywheel is less than the diameter of the inner housing wall at that location, allowing the electrical motor leads 12*a* and 12*b* that supply current to the motor sufficient clearance to avoid contact with the peripheral edge of the flywheel.

In this embodiment, flywheel 19 is purposely formed to be slightly unbalanced, that is its mass is not uniform about its central axis. While such unbalance is possible through use of minimal manufacturing tolerances during the flywheel's manufacture, the present embodiment includes three small vertical passages, 19*a*, that extend through a portion of the outer peripheral rim as illustrated in FIG. 2. In forming the passages, material, hence mass, is removed from that location, creating the desired unbalance. As those skilled in the art appreciate the flywheel may also be made unbalanced by adding a small amount of material to the peripheral edge. The effect of that unbalance is later herein described in connection with the operation.

Disk 21 is placed in the lower housing member in a position above the flywheel. The disk is oriented in a fixed position by means of a key and slot arrangement, best illustrated in FIG. 2. For that arrangement slots 17, only some of which are illustrated, are formed in the peripheral edge of disk 21 with a unique circumferential spacing arrangement. Corresponding elongate vertically oriented protrusions 18, which serve as the key, only some of which are illustrated in FIG. 2, are formed in the inner wall of the housing member and are circumferentially spaced apart along the inner wall of the lower housing member by the same distance as such slots.

Disk 21 is seated upon three inwardly directed protuberances 16, only two of which are illustrated in FIG. 2 formed in and circumferentially evenly spaced about the inner wall of the lower housing member 1*b*, which are located just below the joint formed at the upper end of the lower housing member at a predetermined elevation or height, as variously termed, above tip 7. The ends of those protuberances define an imaginary circle whose diameter is smaller than the diameter of disk 21. Hence, the protuberances prevent disk 21 from descending vertically downward in the lower housing member and seat the disk at a predetermined distance along the top axis from the end of tip 7, while the keys 18 remain engaged in slots 17 at that elevation and prevent the disk from being turned about.

Battery compartment or holder 23 and electrical switch 25 are affixed to the disk 21's upper surface and, in that position, extends in great part above the lower housing portion and within the upper housing portion 1*a*. As shown, the disk contains additional peripheral slots through which electrical leads 12a and 12b from the motor extend up to the level of the battery holder 23 and electrical control switch 25.

As illustrated lower housing member 1b is of a wide diameter at its upper end and tapers to a lesser diameter at its lower end. Accordingly, the diameter of the components that are stacked in the housing assembly at greater heights above tip 7 are larger in diameter than those at lower elevations: The diameter of disk 21 is greater than the diameter of flywheel 19 and that in turn is greater in diameter than disk 15.

Battery holder 23 is a plastic walled rectangular shaped container having two compartments for holding two batteries as shown, suitably type AA batteries, in side by side position, and electrical terminals for making electrical connections from the batteries. A bridging electrical conductor carried in an end wall of the compartment places the two batteries in electrical series circuit. One of the two electrical leads 12b from the motor is attached to one of the remaining electrical contacts in the container to place the motor in series circuit with the batteries.

Electrical switch 25 is an ordinary single pole single throw type switch. An electrical conductor 28 along the bracket extends to the battery contact of the remaining battery at compartment 23 and to one pole of the on-off switch 25. The remaining pole of switch 25 is connected in circuit with the remaining lead 12a from electrical motor 13. A bracket 26 supports electrical on-off switch 25 in a position overlying the battery holder 23. The arms of bracket 26 are sufficiently long so as to place the switches operating arm 9 at the correct vertical height over the upper end of the lower housing member 1b so as to permit the operating arm to pass through the passage 27 in the upper housing member, when assembled, and extend slightly above the surface of that housing member.

Upper housing member 1a is then lowered into place with its tongue groove 11a mating with the mating tongue groove 11b on the lower housing member for a good mechanical fit and a smooth exterior in the appearance of a conventional top. A pair of screws extends through the top to fasten the upper housing member to the bracket holding the switch and, hence, to plastic 21. This allows the batteries to be replaced by simply removing the screws and withdrawing upper housing member 1a to uncover the battery compartment. The unique construction allows for easy fool proof assembly by essentially simple stacking steps.

The batteries, battery container and switch assembly constitute a significant portion of the weight of the assembly. By design the center of gravity of the top assembly with the two AA batteries installed is at a vertical position above flywheel 19, at about the vertical level of disk 21 as represented by the designation "CG" in FIG. 3.

In operation the child draws the operating arm to the "on" position, and electric switch 25 closes a series electrical circuit from the batteries to the motor, supplying electrical current to the motor. The motor rotates its shaft and rotates flywheel 19. Because there is some frictional engagement between shaft 14 and flywheel 19, some time is required before the flywheel attains its normal operating rotational speed.

The heavy rotating flywheel acts as an inertial mass, such as is found in a gyroscope. When the child places tip 7 down on a table top and releases the top, the top's housing also rotates on its central axis, but at lower rotational speed and in the opposite rotational direction than the internal flywheel. That contra-rotational movement is believed to be due to the implementation of the physical principal that for every action, here the torque turning the flywheel, there is an equal and opposite reaction, the counter torque on the motor's support, disk 15 and the housing walls.

The top continues to spin until the batteries are depleted of electricity and/or the user switches the current off. In the latter instances, once the current to the motor is halted, the top continues to spin for some while until the rotational inertia built up in the flywheel is substantially expended. A good play practice is to supply the current to the motor until the flywheel appears to attain its top speed and then switch off the current, playing with the spinning top until the flywheel's inertia is depleted. Thereafter the process may be repeated. This procedure reduces drain on the batteries, while allowing play.

Unlike gyroscopes and as earlier described, the flywheel is purposefully made slightly unbalanced. When the flywheel spins at high speed, what I characterize as pulse energy is produced. Because the center of gravity of the top is located above the flywheel, that pulse energy is focused at tip 7 of the top. The pulse energy causes the tip to start to "walk" along the table top, when the top is slightly disrupted from the vertical, such as by pushing the top slightly. That walking or traveling tip moves in the exact direction necessary to cause gyroscopic precession to bring the top back to the vertical.

Figure 5:
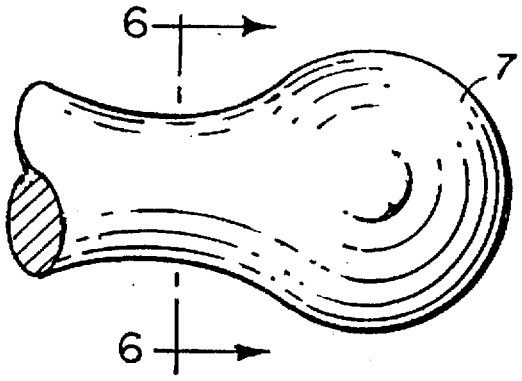
FIG. 5 is an enlarged partial view of the top tip.
Figure 6:
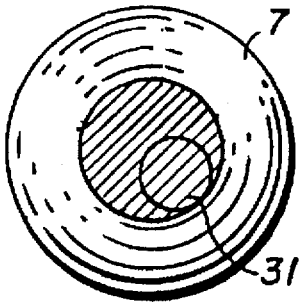
FIG. 6 is a section view of FIG. 5.
Figure 7:
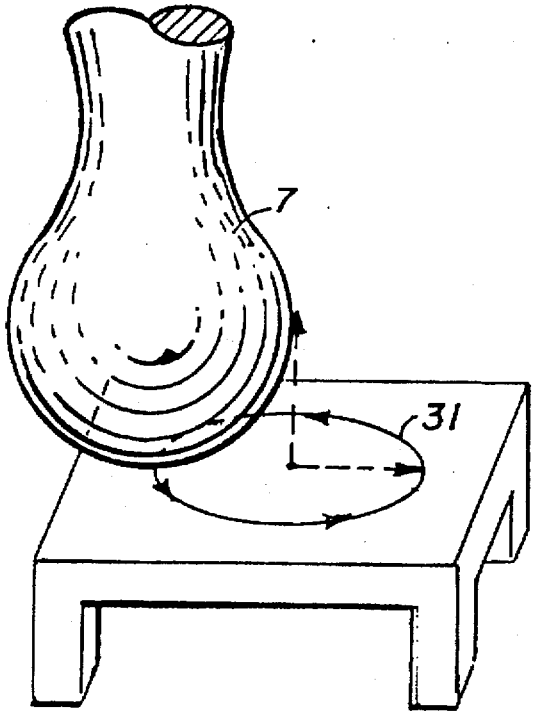
FIGS. 7 and 8 are additional partial pictorial views of the top tip used to illustrate an aspect of the top's operation.
Figure 8:
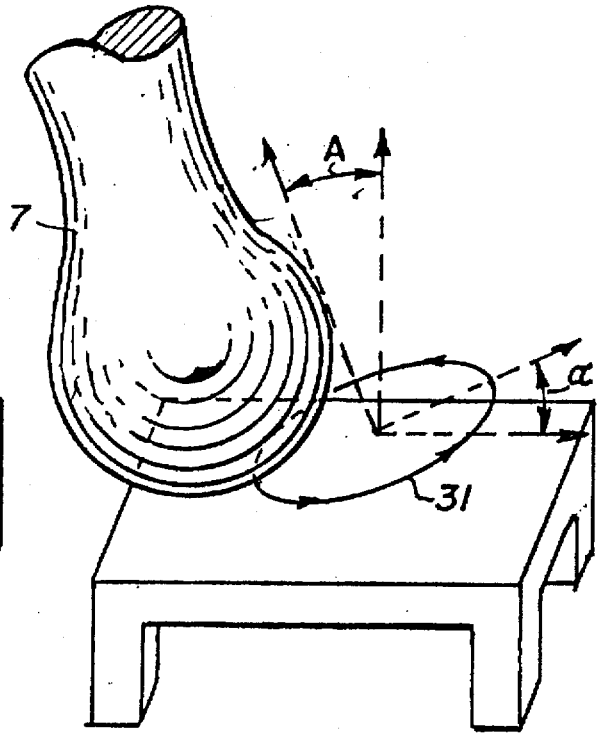

When the top is oriented vertical, the tip simply makes rapid, minute circular orbits. Reference is made to FIGS. 5, 6, 7 and 8, which illustrate the top tip and the described orbits. FIG. 5 illustrates the tip 7 in an enlarged partial view and FIG. 6 illustrates a section view of FIG. 7 taken along the line 6—6. With the top spinning and in vertical orientation, the tip orbits in a small circle 31 of about twenty five to thirty five thousandths of an inch in diameter, illustrated in an exaggerated diameter in FIG. 6. This same movement is illustrated pictorially in FIG. 7, with orbit 31 being even more exaggerated in diameter in this illustration as the top orbits on the table top in the same plane as the table top. However, when the top starts to tilt from the vertical, as represented in FIG. 8, the plane of orbit is no longer coincident with the plane of the table top surface, but becomes inclined thereto, as represented in the figure by the inclination A. The orbiting tip no longer is in contact with the table top surface for the full orbit. The tip starts to walk sideways causing gyroscopic precession to right the top. In addition to the novel construction described, the additional structural features produce an unusual form of motion that should enhance a child's play.

It is believed that the foregoing description of the preferred embodiments of the invention is sufficient in detail to enable one skilled in the art to make and use the invention. However, it is expressly understood that the detail of the elements presented for the foregoing purposes is not intended to limit the scope of the invention, in as much as equivalents to those elements and other modifications thereof, all of which come within the scope of the invention, will become apparent to those skilled in the art upon reading this specification. Thus the invention is to be broadly construed within the full scope of the appended claims.

What is claimed is:

1. A spinning top apparatus comprising:

A hollow housing formed of plastic material, said housing having a central axis and having outer walls defining a curved figure that is symmetrical about said central axis and reduces to a narrow tip at one end;

said housing comprising a lower housing portion and an upper housing portion, said upper housing portion and said lower housing portion being mechanically interlocked in meshing engagement to define a smooth curved surface that tapers from a wide diameter to a narrow bulbous tip portion at a bottom end to resemble a toy top in appearance;

an electric motor, containing a front end and a back end and a shaft, said shaft extending outwardly from said front end;

said electric motor being oriented coaxial with said central axis, and said motor front end facing away from said bulbous tip portion, with said shaft being oriented coaxial with said central axis and extending in a direction vertically upwardly away from said bulbous tip portion;

a first disk defining a barrier to said motor and containing a central passage, said first disk being disposed within said lower housing portion at a position therewith overlying said front end of said motor and at a first predetermined elevation from said bulbous tip portion and being oriented perpendicular to said central axis;

a flywheel, said flywheel having a principal axis that is oriented coaxial with said central axis and a passage through said central axis for coupling said flywheel to said motor shaft, whereby said flywheel is oriented for rotation about said central axis;

a second disk, said second disk being disposed at an upper end of said lower housing member oriented perpendicular to said central axis;

battery holder means carried upon on an upper surface of said second disk;

electric switch means carried upon said battery holder means, said electric switch means including a switch operating arm;

said battery holder means and said electric switch means extending within said upper housing portion;

electrical conductor means for connecting said battery holder means, said switch means and said DC motor means in electrical series circuit;

said upper housing portion having an upper surface, said upper surface containing a passage for said switch operating arm; and said switch operating arm extending through said passage in said upper housing portion.

2. The invention as defined in claim 1, wherein said motor shaft extends through said central passage in said first disk; and wherein said first disk supports said motor in an elevated position above said bulbous tip portion of said lower housing portion, whereby said back end of said motor is elevated from said bulbous tip portion.

3. The invention as defined in claim 1 wherein said flywheel is positioned between said first and second disks.

4. The invention as defined in claim 2 wherein said flywheel is positioned between said first and second disks.

5. The invention as defined in claim 4, wherein said battery holder means further includes battery means; and wherein said recited elements define a center of gravity to said spinning top apparatus, said center of gravity being located at a position on said top apparatus above said flywheel.

6. The invention as defined in claim 1 wherein said flywheel comprises a mechanically unbalanced load.

7. The invention as defined in claim 1, wherein said flywheel includes at least one small passage extending therethrough, said one small passage being located along a circumferential edge of said flywheel, whereby said flywheel is mechanically unbalanced.

8. The invention as defined in claim 5, wherein said flywheel includes at least one small passage extending therethrough, said one small passage being located along a circumferential edge of said flywheel, whereby said flywheel is mechanically unbalanced.

9. The invention as defined in claim 1, wherein said flywheel includes a plurality of axially extending passages through a circumferential edge portion, said passages being clustered along a narrow arc portion of said flywheel's circumference for mechanically unbalancing said flywheel.

10. A spinning top apparatus comprising:

A hollow housing formed of plastic material, said housing having a central axis, a flat upper surface, outer walls defining a curved figure that is symmetrical about said central axis and reduces to a narrow tip at a bottom end and inner walls defining a hollow cavity;

said housing comprising a lower housing member and an upper housing member, said upper housing member and said lower housing member being mechanically interlocked in meshing engagement to define a smooth curved outer surface that curves from said flat upper surface outwardly from said central axis and around and then curves inwardly toward said central axis tapering to a narrow bulbous tip portion at a bottom end to resemble a toy top in appearance;

a DC motor, containing a front end and a back end and a shaft, said shaft extending outwardly from said front end;

said DC motor being oriented coaxial with said central axis, and said motor front end facing away from said bulbous tip portion, said shaft being oriented coaxial with said central axis and extending from said front end in a direction vertically upwardly away from said bulbous tip portion;

a first disk, said first disk being formed of plastic material and comprising a generally circular geometry, said first disk including a plurality of perforations therethrough and being of a first diameter, said first disk being disposed within said lower housing portion at a position therewith over said front end of said motor and at a first predetermined elevation from said bulbous tip portion and being oriented perpendicular to said central axis, and said first disk containing a plurality of spaced slots extending inwardly from a peripheral edge and a central passage, said motor shaft extending through said central passage, whereby a portion of said shaft extends to a vertical position above said first disk;

means for connecting said front end of said motor to an under side surface of said first disk to suspend said motor from said first disk, wherein said first disk supports said motor with said back end of said motor positioned above said tip portion of said housing;

a flywheel, said flywheel comprising a metal material and being of a second diameter, said second diameter being less than said first diameter, said flywheel having a principal axis that is oriented coaxial with said central axis and a passage through said central axis for coupling said flywheel to said motor shaft, whereby said flywheel is oriented for rotation by said motor about said central axis;

said flywheel including a plurality of axially extending passages through a circumferential edge portion, said passages being clustered along a narrow arc portion of said flywheels circumference for mechanically unbalancing said flywheel;

a second disk formed of plastic material, said second disk being of a third diameter, said second disk being positioned at an upper end of said lower housing member oriented perpendicular to said central axis, said second disk including a plurality of perforations therethrough and containing a plurality of spaced slots extending inwardly from a peripheral edge, said spaced slots being spaced from one another by various distances;

said inner wall of said lower housing member including a first set of protrusions extending radially inwardly, comprising at least three in number, for seating said second disk within said lower housing portion in a position above said flywheel and at a predetermined distance above said tip and preventing said second disk from movement further downward in said lower housing portion;

said first set of protrusions being positioned at a predetermined distance from said bulbous tip portion and being circumferentially spaced from one another and radially inwardly projecting from said inner wall, the ends of said protrusions defining a circle having a diameter smaller than said diameter of said second disk and greater than said diameter of said first disk and said flywheel;

said inner wall of said lower housing member further including a second plurality of protrusions, each said protrusion in said second plurality of protrusions extending radially inwardly and extending vertically downwardly from a position at an upper end of said lower housing member to a position above said first disk to define keys for the peripheral slots in said second disk, said protrusions in said second plurality of protrusions being spaced from one another by the same predetermined spacing distances that space said slots in said peripheral edge of second disk for engaging respective ones of said peripheral slots, whereby said second disk may be seated on said first set of protrusions only when said slots receive said keys;

battery holder means carried upon on an upper surface of said second disk;

electric switch means carried upon said battery holder means in a position overlying said battery holder means, said electric switch means including a switch operating arm;

said battery holder means and said electric switch means extending within said upper housing portion;

electrical conductor means for connecting said battery holder means, said switch means and said DC motor means in electrical series circuit;

said flat upper surface containing a passage for said switch operating arm; and said switch operating arm extending through said passage in said upper housing portion.

11. The spinning top apparatus as defined in claim 10, wherein said battery holder means includes battery means for supplying electrical current; and wherein said aforecited elements define a center of gravity to said spinning top apparatus located at a position above said flywheel.

* * * * *